US010800592B2

(12) United States Patent
Sevim

(10) Patent No.: US 10,800,592 B2
(45) Date of Patent: Oct. 13, 2020

(54) SELF-HEATING CONTAINER FOR PRE-COOKED FOOD

(76) Inventor: Nicky Sevim, Montreux (CH)

( * ) Notice: Subject to any disclaimer, the term of this patent is extended or adjusted under 35 U.S.C. 154(b) by 127 days.

(21) Appl. No.: 13/819,527

(22) PCT Filed: Mar. 15, 2012

(86) PCT No.: PCT/IB2012/000482
§ 371 (c)(1),
(2), (4) Date: Sep. 25, 2014

(87) PCT Pub. No.: WO2013/136104
PCT Pub. Date: Sep. 19, 2013

(65) Prior Publication Data

US 2015/0017287 A1 Jan. 15, 2015

(51) Int. Cl.
*B65D 81/34* (2006.01)
*F24V 30/00* (2018.01)

(52) U.S. Cl.
CPC ..... *B65D 81/3484* (2013.01); *F24V 30/00* (2018.05)

(58) Field of Classification Search
CPC ..... B65D 81/3484; B65D 81/3407; B65D 81/34; B65D 81/3216; B65D 81/3233; B65D 21/043; B65D 21/0226; B65D 21/00; B65D 21/02; B65D 21/0209; B65D 21/0204; B65D 21/0212; B65D 21/0213; B65D 21/0215; B65D 21/0216;
(Continued)

(56) References Cited

U.S. PATENT DOCUMENTS 2,265,172 A * 12/1941 Katz ..... A47J 36/28
126/263.06
2,425,900 A * 8/1947 Ray ..... A47J 36/28
426/113

(Continued)

FOREIGN PATENT DOCUMENTS

EP 1166699 A2 * 1/2002 ..... A47J 36/28
ES 2146494 A1 * 8/2000

(Continued)

OTHER PUBLICATIONS

FR 2659940 Espacenet Translation.*
FR 2658061 Espacenet Translation.*

*Primary Examiner* — Erik Kashnikow
*Assistant Examiner* — Ashley Axtell
(74) *Attorney, Agent, or Firm* — Hoglund & Pamias, PSC; Roberto J. Rios

(57) ABSTRACT

This container comprises: an outer receptacle containing a lower vessel carrying calcium oxide, a water bag and a striker to break the bag and mix the water with the calcium oxide causing an exothermic reaction; and an upper vessel carrying the pre-cooked food and fixed on the lower vessel. The outer receptacle has on its side surface: recessed sectors and projecting sectors forming hollow side chambers between the lower container and the side surface of the outer receptacle and, in correspondence with the upper end of the mentioned vertical sectors, a perimetral step for the linear support of a projecting rim defined in the upper opening of the lower vessel. The upper vessel comprises a perimetral step in an area close to its upper end for its support and fixing by means of an adhesive on the projecting upper rim of the lower vessel.

2 Claims, 4 Drawing Sheets

(58) Field of Classification Search
CPC ..... B65D 21/0217; B65D 21/0219; B65D 21/0222; B65D 21/0223; B65D 21/0233; B65D 77/08; B65D 81/3205; B65D 77/04; B65D 77/0443; B65D 77/0446; B65D 77/0486; B65D 77/0493; A47J 36/28; A47J 36/24; A47J 36/30; A47J 36/2444; A47J 36/2438; A47J 41/0072; A47J 41/0038; A47J 27/0804; A47J 27/082; A47J 27/026; A47J 27/13; A47J 27/084; A47J 27/05; A47J 31/441; A47J 31/4453; F24J 1/00; C09K 5/18; B65B 81/3484; B65B 81/34; F24V 30/00
USPC ..... 426/114, 109, 115, 110, 111, 112, 119; 126/263.01, 263.05, 263.08, 263.09, 126/263.06; 206/515, 514, 499, 501, 505, 206/504; 220/560.05, 560.08, 552, 547, 220/546, 544, 532, 534, 543, 549, 555, 220/556, 297, 4.26, 23.6, 573.5
See application file for complete search history.

(56) References Cited

U.S. PATENT DOCUMENTS 2,733,709 A * 2/1956 Sukacev ..... A47J 36/28 126/262
3,070,275 A * 12/1962 Donald ..... B65D 51/28 220/500
3,094,981 A * 6/1963 Brewer ..... A47J 36/28 126/263.05
3,443,715 A * 5/1969 Edwards ..... B65D 1/265 206/499
3,759,416 A * 9/1973 Constantine ..... B65D 21/0233 206/505
4,762,113 A * 8/1988 Hamasaki ..... B65D 81/3484 126/261
4,793,323 A * 12/1988 Guida ..... A47J 36/28 122/21
4,823,769 A * 4/1989 Semaan ..... F24J 1/00 126/262
2007/0125362 A1* 6/2007 Ford ..... F24V 30/00 126/263.08
2007/0221197 A1* 9/2007 Sevim ..... B65D 81/3484 126/263.09
2010/0078440 A1* 4/2010 Bargan ..... B65D 81/3484 220/592.2

FOREIGN PATENT DOCUMENTS

FR 2658061 A1 * 8/1991 ..... A47J 36/28
FR 2659940 A1 * 9/1991 ..... A47J 36/28

* cited by examiner

SELF-HEATING CONTAINER FOR PRE-COOKED FOOD

OBJECT OF THE INVENTION

The present invention relates to a self-heating container for pre-cooked food of the type comprising: —an outer receptacle having a base, a side surface and an upper opening; —a lower vessel having a base, a side surface and an upper opening, housed inside the receptacle and carrying components the of which mixture causes an exothermic reaction and a striker to break a bag containing one of said components; and—an upper vessel carrying the pre-cooked food, provided with a base, a side surface and an upper opening with a closure lid, said upper vessel being fixed to the outer receptacle and to the periphery of the upper end of the lower vessel by means of an adhesive product.

FIELD OF APPLICATION OF THE INVENTION

This invention is applicable in the food packaging sector, and more specifically in the pre-cooked food packaging sector intended for heating the food prior to consumption.

BACKGROUND OF THE INVENTION

Containers for pre-cooked elements having means for autonomous heating are currently known.

Document ES 2 146 494 discloses a container for pre-cooked foods provided with means for heating the packaged food product which is formed from a vessel with a rectangular base made of a plastic material that is resistant to high temperatures, having in the perimeter of its mouth a protruding rib, there being in the upper central area of each of its sides a rectangular aperture demarcated at the top by the protruding rib, having in the central area of one of its larger sides a hole positioned in the lower area of the side where it is incorporated, a considerably elongated body finished at one of its ends with a sharp configuration being fixed on this same side and the opposite side being provided with a spherical configuration fixed to the outer surface of the container by conventional means, having on the container, and specifically on the perimeter of its mouth, a body with a rectangular base (10) provided with a wide central aperture, on the surface of its side, and specifically in each of the same two rectangular apertures, the container being able to be incorporated inside a vessel made of polyurethane foam.

Document ES 2 176 086 relating to a container for pre-cooked foods, of the same type as the one described above but in which the aluminum receptacle internally houses, in a centered position with respect to the base, a striking means to break the bag containing water by means of the user applying pressure on the bottom of the container, is also known. In this document, the can containing the food product is fixed by means of gluing the base to the upper edge of the aluminum receptacle and the side to the cardboard receptacle, thereby assuring the positioning thereof on the mentioned reaction products.

In self-heating containers of this type, the lower vessel containing the products intended to cause the exothermic reaction and accordingly heating the upper vessel containing the pre-cooked food to be heated virtually contacts with the entire base and side surface with the outer receptacle which can be made of pressboard or plastic.

This raised contact surface between the lower vessel where the exothermic reaction takes place and the outer receptacle means that a great deal of the heat released is transmitted directly to the outer receptacle with the subsequent risk of burns for the user and the waste thereof in heating the upper vessel containing the pre-cooked food to be heated.

Another drawback of known containers of this type is that the upper vessel containing the food also fits inside the receptacle, the entire side surface virtually contacting with the side surface of the outer receptacle, which means that the contact between the upper vessel to be heated and the lower vessel where the exothermic reaction takes place is established only by means of the base of said upper vessel.

This means that a great deal of the heat released in the exothermic reaction is not used in heating the upper vessel and is transmitted directly to the exterior due to the contact between the base and side surface of the lower vessel with the base and side surface of the outer receptacle.

DESCRIPTION OF THE INVENTION

The self-heating container for pre-cooked food object of this invention is of the type comprising:—an outer receptacle having a base, a side surface and an upper opening;—a lower vessel having a base, a side surface and an upper opening, and being housed inside the outer receptacle, said lower vessel carrying calcium oxide, a water bag and a striker to break the bag and mix the water with the calcium oxide causing an exothermic reaction; and—an upper vessel carrying the pre-cooked food, provided with a base, a side surface and an upper opening with a closure lid; said upper vessel being fixed to the outer receptacle and to the periphery of the upper end of the lower vessel by means of an adhesive product.

This self-heating container has features aimed at optimizing use of the heat released in the exothermic reaction of the products contained in the lower vessel for heating the foods contained in the upper vessel.

Another objective of the invention is to maximize the surface of the upper vessel exposed to the heat released by the reaction of the components contained in the lower vessel, allowing a reduction of the amounts of product (calcium oxide and water) to be included in the lower vessel to effectively heat the upper vessel.

Another objective of the invention is to minimize the contact surfaces between the lower vessel and the outer receptacle reducing the loss of heat through the side surfaces and the lower base of the outer receptacle, further reducing the risk of burns for the user when handling the container once it is hot.

To that end and according to the invention the outer receptacle has, alternately arranged along its outer surface, recessed sectors for centering the lower vessel with respect to the outer receptacle, and projecting sectors forming hollow side chambers between the lower container and the side surface of the outer receptacle, thereby preventing a direct loss of the heat generated during the exothermic reaction through the side surfaces of the outer receptacle.

This outer receptacle has, in correspondence with the upper end of the mentioned vertical sectors, a perimetral step for the linear support of a projecting upper rim defined in the upper opening of the lower vessel; the upper vessel comprising a perimetral step in an area close to its upper end for its support and fixing by means of an adhesive on the projecting upper rim of the lower vessel; most of the outer surface of the upper vessel being arranged under the mentioned perimetral step and inside the lower vessel.

The entire surface of the upper vessel is thereby virtually exposed directly to the heat released by the exothermic reaction occurring in the lower vessel.

Another feature of the invention is that the lower vessel has vertical assembly guides on its side surface intended for being coupled in respective vertical sectors projecting from the side surface of the outer receptacle. Both said vertical guides and the respective vertical sectors of the outer receptacle have complementary stepped portions in an intermediate area forming support areas for the lower vessel with respect to the outer receptacle. Stability of the lower vessel with respect to the outer receptacle is thereby assured, providing a support area additional to that formed by the upper rim of the lower vessel on the perimetral step of the outer receptacle.

Another feature of the invention consists of the lower vessel having a projecting diametrical portion at its base forming an inner housing for positioning the striker, the pressure of which causes the water bag to break and the mixture of the water with the calcium oxide, with the subsequent initiation of the exothermic reaction.

This projecting diametrical portion containing the striker is responsible for contacting with the base of the outer receptacle, the rest of the base of the lower vessel being arranged spaced from the base of the outer receptacle, which minimizes the outward loss through the base of the outer receptacle of the heat released by the exothermic reaction occurring inside the lower vessel.

DESCRIPTION OF THE DRAWINGS

To complement the description that is being made and for the purpose of aiding to better understand the features of the invention, a set of drawings is attached to this specification in which the following is depicted with an illustrative and non-limiting character.

PREFERRED EMBODIMENT OF THE INVENTION

Figure 1:
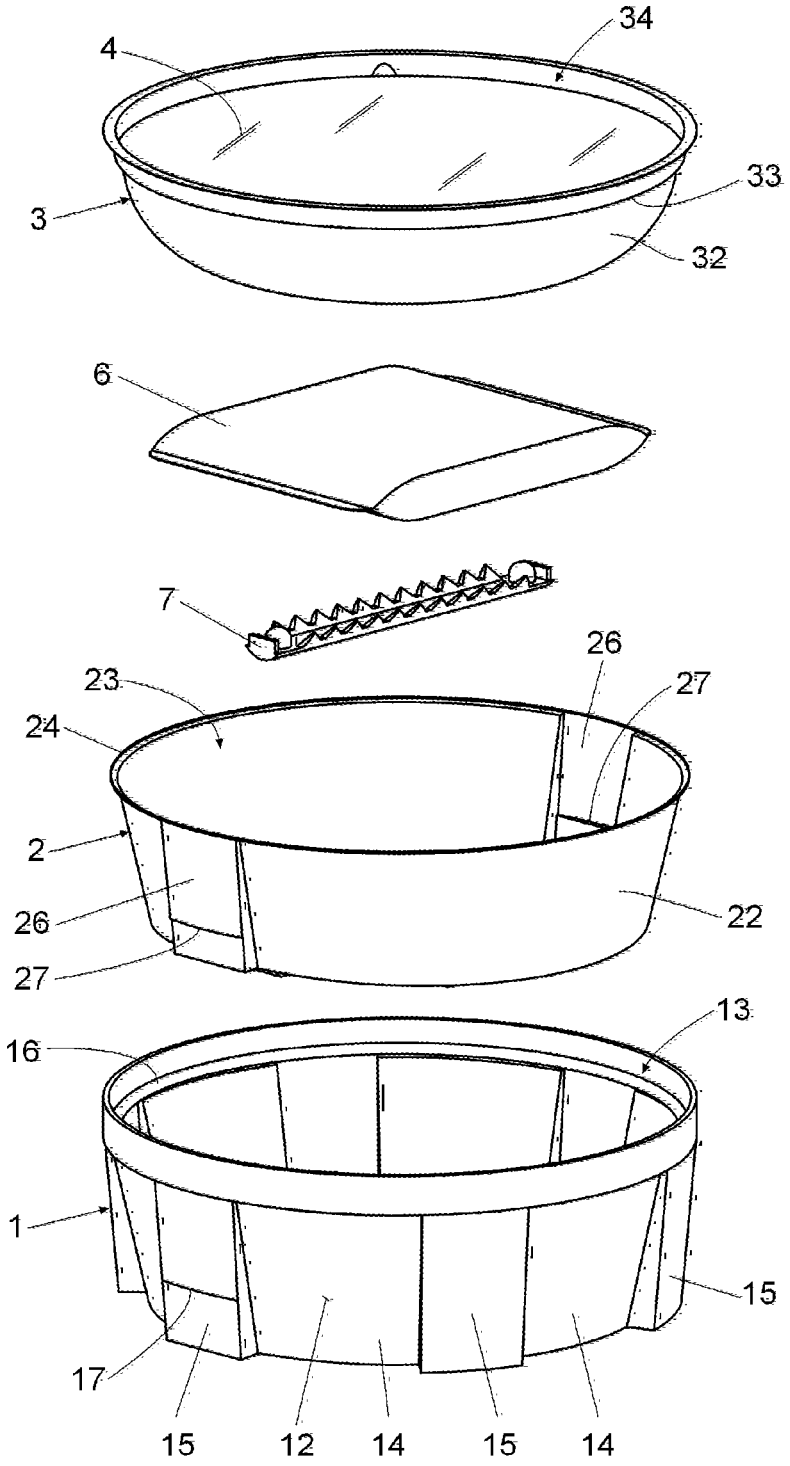
FIGS. 1 and 2 show respective exploded top and bottom perspective views of the different elements forming the self-heating container for pre-cooked food according to the invention, with the exception of the calcium oxide which has not been depicted as it is a powder material contained in the lower vessel.
Figure 2:
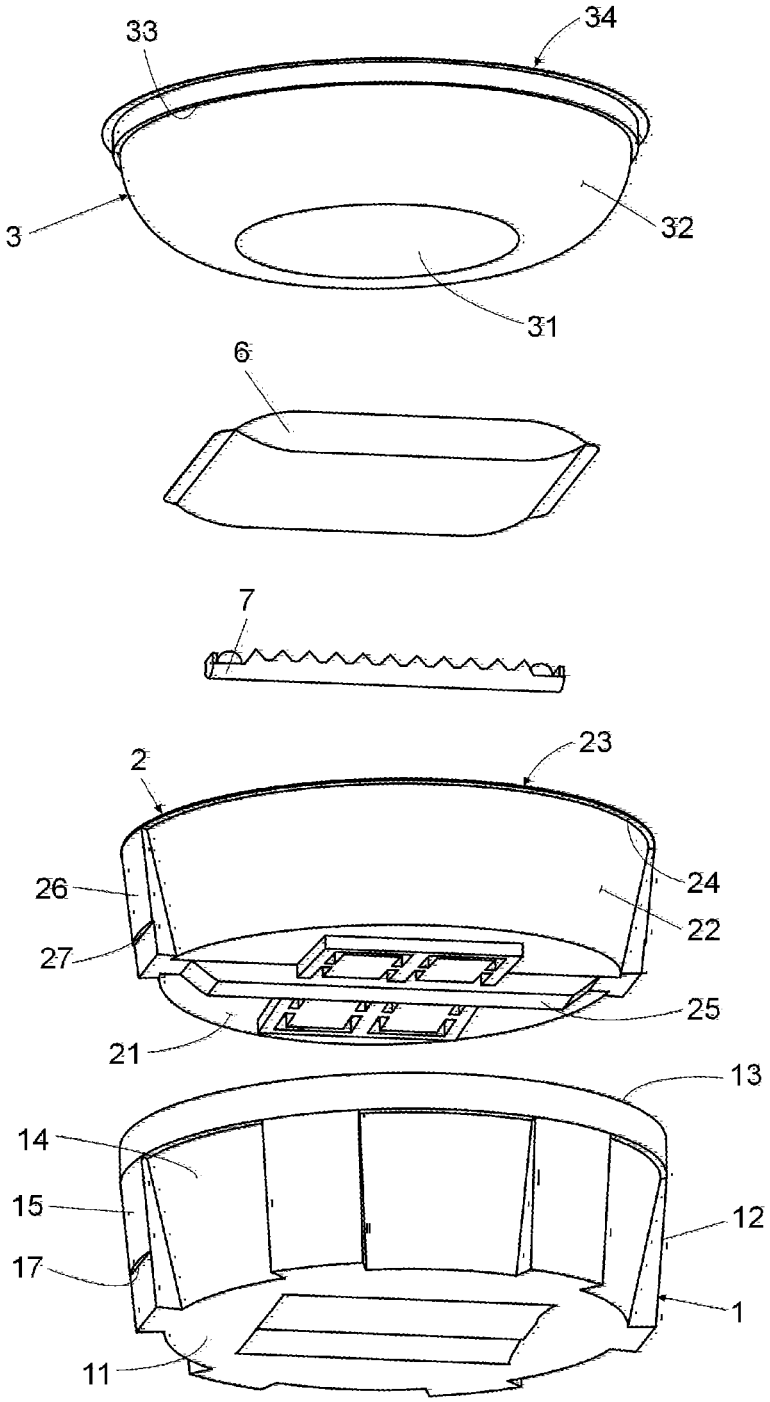
Figure 3:
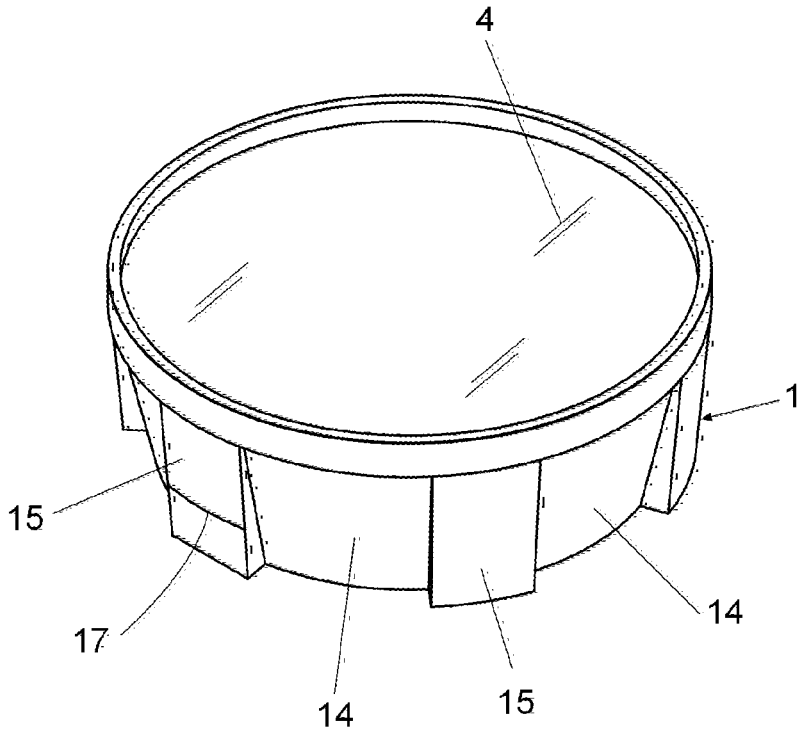
FIG. 3 shows a perspective view of the self-heating container according to the invention in the assembled position.
Figure 4:
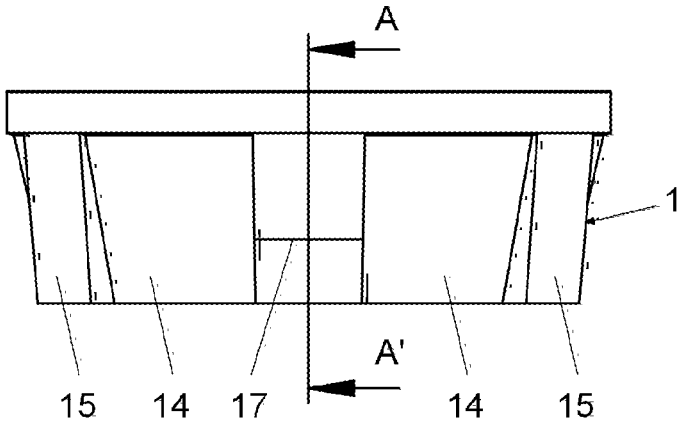
FIG. 4 shows an elevational view of the self-heating container of the previous figures in the assembled position.

In the embodiment shown in the attached figures, the self-heating container comprises an outer receptacle (1) where a lower vessel (2) and an upper vessel (3) are stored, fixed to one another as described below.

The outer receptacle (1), formed in this case from recycled cardboard, has a base (11), a side surface (12) and an upper opening (13). Said outer receptacle (1) has, alternately arranged on its side surface, (12) recessed sectors (14) and projecting sectors (15) finished at the top with a perimetral step (16) forming a first linear support surface of the lower vessel (2).

Two diametrically opposed projecting sectors (15) have in their intermediate area a stepped portion (17) forming a second support surface for the lower vessel (2).

The lower vessel (2), formed in this case from aluminum, has a base (21), a side surface, and an upper opening (23) with a projecting rim (24) for its linear support on the perimetral step (16) of the outer receptacle (1).

Figure 5:
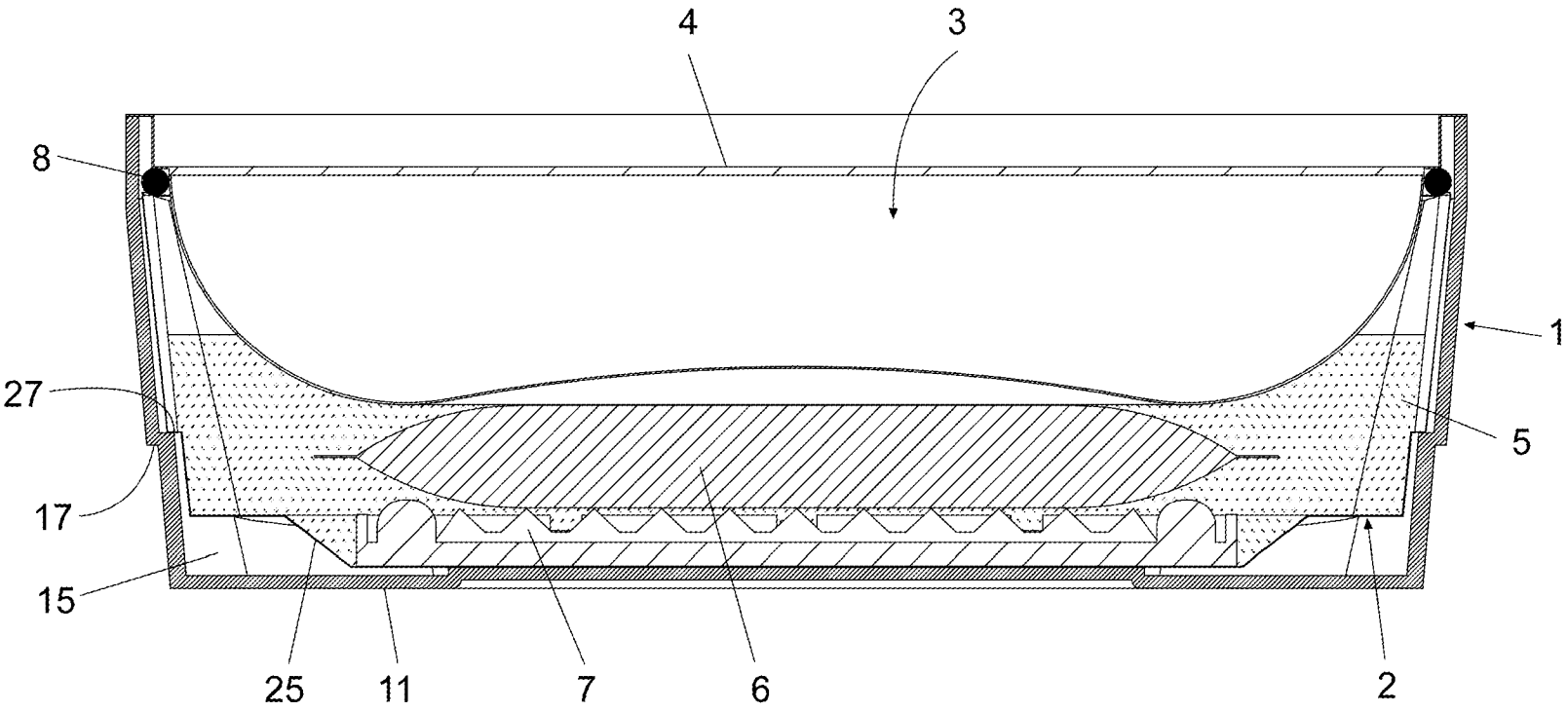
FIG. 5 shows a profile view of the self-heating container sectioned by the vertical plane referenced as A-A in FIG. 4.

This lower vessel (2) has a diametrical portion (25) at its base projecting forming an inner housing for positioning a striker (7) which, when pressed by the user from the bottom of the container, causes the water bag (6) housed inside the lower vessel to break and the water to mix with another component, in this case calcium oxide (5), also arranged inside the lower vessel, as shown in FIG. 5, causing an exothermic reaction releasing the heat necessary for heating the upper vessel (3) containing a pre-cooked food.

The lower vessel (2) has two vertical guides (26) in diametrically opposed positions for its assembly in those projecting sectors (15) provided with the intermediate stepped portions (17).

These vertical guides (26) have stepped portions (27) complementary to those of the outer receptacle (1), both stepped portions (17, 27) forming complementary support areas for the lower vessel (2) with respect to the outer receptacle (1).

The upper vessel (3) containing the pre-cooked element to be heated has a base (31) and a side surface (32) having a perimetral step (33) in an area close to its upper opening (34).

This upper opening (34) is provided with a closure lid (4) conserving the pre-cooked foods contained in the upper vessel (3) until the container is used.

As can be seen in FIG. 5, the arrangement of the perimetral step (33) of the upper vessel (3) in an area close to its upper opening (34) determines that once the upper vessel (3) is fixed through its perimetral step (33) on the projecting rim (24) of the lower vessel (2) by means of a strip of adhesive (8), virtually the entire outer surface of the upper vessel (3) is housed inside the lower vessel (2) and therefore directly exposed to the heat released by the reaction of the components contained in the lower vessel (2).

As mentioned above and as can be seen in FIG. 5, in the assembly position the base (21) of the lower vessel (2) is spaced from the base (11) of the outer receptacle, with the exception of the diametrical portion (25) containing the striker (7), considerably reducing the outward loss of heat through the mentioned base (11) of the outer receptacle (1)

Likewise, the projecting sectors (15) defined in the side surface (12) of the outer receptacle (1) form hollow chambers between the side surfaces (12,22) of the outer receptacle (1) and of the lower vessel (2) which reduce the outward loss of heat through the side surface of the mentioned outer receptacle (1) and allow housing portions of the side surface of the lower vessel (2) if the latter expands laterally due to the effect of the exothermic reaction occurring therein.

This expansion occurs primarily when said lower vessel is formed from aluminum foil and has side folds that readily expand during the exothermic reaction caused by the mixture of components contained therein.

Having sufficiently described the invention as well as a preferred embodiment thereof, it is hereby stated for all effects and purposes that the materials, shape size and arrangement of the described elements can be modified provided that it does not entail an alteration of the essential features of the invention claimed below.

The invention claimed is:

1. A self-heating container for pre-cooked food comprising a round-shaped upper vessel carrying the pre-cooked food, provided with a base, a side surface and an upper opening with a closure lid;

a round-shaped lower vessel having a base, a side surface and an upper opening, being housed in a round-shaped outer receptacle and carrying calcium oxide, a water bag and a striker to break the water bag and mix water from said water bag with the calcium oxide causing an exothermic reaction, wherein said round-shaped lower vessel is formed from aluminum foil and has side folds that expand during said exothermic reaction; and the round-shaped outer receptacle having a base, a side surface, an upper opening having an upper end and an outer receptacle perimetral step located below said upper end forming a first support surface of the round-shaped lower vessel, the round-shaped outer receptacle has alternately arranged along its outer side surface, vertical recessed sectors and vertical projecting sectors that project away from an interior of said round-shaped outer receptacle and longitudinally extend from said outer receptacle perimetral step to said outer receptacle base thereby optimizing use of the heat from the exothermic reaction from the round-shaped lower vessel for heating the pre-cooked food contained in the round-shaped upper vessel;

the round-shaped lower vessel is centered with respect to the round-shaped outer receptacle by means of said vertical recessed sectors, wherein said vertical projecting sectors form hollow side chambers between the round-shaped lower vessel and the side surface of the round-shaped outer receptacle minimizing loss of heat through the side of the round-shaped outer receptacle and allowing the lower vessel side surface to expand laterally due to the exothermic reaction;

said outer receptacle perimetral step supporting a lower vessel projecting rim defined in the upper opening of the round-shaped lower vessel, said round-shaped lower vessel has only a single pair of opposed vertical assembly guides on its side surface projecting away from an interior of said round-shaped lower vessel and longitudinally extending from said lower vessel projecting rim to said lower vessel base, said single pair of opposed vertical assembly guides being received only inside a single pair of opposed vertical projecting sectors of said plurality of vertical projecting sectors of the round-shaped outer receptacle preventing rotational movement of said round-shaped lower vessel inside said round-shaped outer receptacle and minimizing the contact surface between the round-shaped outer receptacle and the round shaped lower vessel, thereby reducing loss of heat and risk of burns for a user handling the container, wherein each of said single pair of opposed vertical projecting sectors has a stepped portion supporting a complementary stepped portion provided on each vertical assembly guide of said single pair of opposed vertical assembly guides, forming a second support surface of the round-shaped lower vessel so that the base of said round-shaped lower vessel is separated from the base of said round-shaped outer receptacle additionally minimizing outward heat loss through the base of the round-shaped outer receptacle;

wherein the round-shaped lower vessel has a projecting diametrical portion at its base forming an inner housing for positioning the striker and contacting with the base of the round-shaped outer receptacle, the rest of the base of the round-shaped lower vessel being arranged spaced from the base of the round-shaped outer receptacle additionally minimizing loss of heat through the base of the round-shaped outer receptacle; and the round-shaped upper vessel comprises an upper vessel projecting rim defined in the upper opening and an upper vessel perimetral step located below said upper vessel projecting rim, wherein the upper vessel perimetral step is supported on said lower vessel projecting rim and the upper vessel projecting rim is supported on the upper end of said round-shaped outer receptacle, most of the outer surface of the round-shaped upper vessel being arranged under the outer receptacle perimetral step and inside the round-shaped lower vessel so that the base and the side surface of the round shaped upper vessel are directly exposed to the heat released by the exothermic reaction of the water and the calcium oxide contained in the round-shaped lower vessel.

2. The container according to claim 1, wherein said complementary stepped portions are located in an intermediate area of said single pair of opposed vertical assembly guides and said stepped portions are located in an intermediate area of said single pair of opposed vertical projecting sectors forming support areas for the round-shaped lower vessel with respect to the round-shaped outer receptacle.

* * * * *